US006408757B2

(12) United States Patent
Ogawa et al.

(10) Patent No.: US 6,408,757 B2
(45) Date of Patent: Jun. 25, 2002

(54) PAPER ROLL BRAKING DEVICE

(75) Inventors: Yukio Ogawa, Chgasaki; Nobuaki Hashimoto, Hachiouji; Takanobu Sakakura, Inagi; Atushi Satoh, Kawasaki, all of (JP)

(73) Assignee: Tokyo Kikai Seisakusho, Ltd. (JP)

( * ) Notice: Subject to any disclaimer, the term of this patent is extended or adjusted under 35 U.S.C. 154(b) by 0 days.

(21) Appl. No.: 09/751,921

(22) Filed: Dec. 21, 2000

(30) Foreign Application Priority Data

Dec. 22, 1999 (JP) ..... 11-364102

(51) Int. Cl.[7] ..... B41F 13/016

(52) U.S. Cl. ..... 101/480; 101/228; 101/232; 242/421

(58) Field of Search ..... 101/228, 219, 101/212, 232, 480; 242/421, 421.5, 421.6, 421.8

(56) References Cited

U.S. PATENT DOCUMENTS 1,780,194 A * 11/1930 Kende ..... 188/83
3,957,221 A * 5/1976 Palovaara ..... 242/423.1
4,494,710 A * 1/1985 Harris et al. ..... 242/156
6,293,192 B1 * 9/2001 Bartlett ..... 101/212

FOREIGN PATENT DOCUMENTS

JP Hei-4(1992)-16762 2/1992

* cited by examiner

*Primary Examiner*—Daniel J. Colilla
(74) *Attorney, Agent, or Firm*—McGlew and Tuttle, P.C.

(57) ABSTRACT

A paper roll braking device for rotary presses, in which a web is paid off from a paper roll supported between frames, caused to travel, and printed in a printing unit, comprising rotors provided on supporting members for supporting the paper roll, braking sections provided at a plurality of locations along the rotors and having friction discs that can engage with, or disengage from, the rotors at their respective locations, engage/disengage changeover sections for controlling the engage/disengage operation of the friction discs with respect to the rotors, and a tension sensing mechanism for sensing changes in the running tension of the web; a contact pressure adjusting section for adjusting the contact pressure of the friction discs to the rotors via the engage/disengage changeover section in accordance with the changes in running tension detected by the tension sensing mechanism, an outside diameter detecting section for detecting the outside diameter of the paper roll, and an operation control section for switching the engage/disengage changeover section as the paper roll outside diameter detected by the outside diameter detecting section reaches a predetermined diameter are provided.

15 Claims, 3 Drawing Sheets

PAPER ROLL BRAKING DEVICE

BACKGROUND OF THE INVENTION

1. Field of the Invention

The present invention relates to a paper roll braking device for rotary presses adapted to brake the revolution of the paper roll so as to control the running tension of a web that is paid off from the paper roll and caused to travel.

2. Description of the Prior Art

The aforementioned paper roll braking device has already been disclosed in a considerable literature, such as Japanese Published Unexamined Utility Model Application No. Hei-4(1992)-16762, for example. In Japanese Published Unexamined Utility Model Application No. Hei-4(1992)-16762, disclosed are the following three paper roll braking devices:

① A paper roll braking device comprising an shaft-end braking device having a brake disc fixedly fitted to an end of a paper roll supporting shaft, a pneumatically operated cylinder, and a brake shoe fitted to an end of a cylinder output shaft, in which the tension of a web paid off from a paper roll is detected by a tension sensor connected to a pickup roller disposed on the web traveling path, the detected signal is compared with a predetermined tension value preset in a control section, if the comparison result shows any discrepancy, a control signal is fed from the control section to an electric-pneumatic converter via an amplifier to actuate the electric-pneumatic converter to regulate air pressure to a brake changeover valve, and the regulated air pressure forces the brake shoe onto the brake disc to brake the revolution of the paper roll, thereby controlling the tension of a traveling paper web paid off from the paper roll to a predetermined tension.

② A paper roll braking device having a surface braking device that forces a plurality of lining belts onto the outer periphery of a paper roll to brake the revolution of the paper roll, thereby controlling the acceleration of the paper roll and the tension of a traveling paper web paid off from the paper roll.

③ A paper roll braking device in which a shaft-end braking device fitted to an end of a paper roll supporting shaft, and a surface braking device that causes a brake belt onto the outer periphery of a paper roll are provided, and the tension of a traveling paper web is controlled by braking the revolution of the paper roll with the surface braking device until after the diameter of the paper roll reaches a predetermined value, and with the shaft-end braking device after the diameter of the paper roll is smaller than the predetermined value.

The foregoing three paper roll braking devices have the following problems and shortcomings.

The paper roll braking device of ① adjusts the tension of the web by forcing the brake shoe onto the brake disc provided on the paper roll supporting member so that the braking force based on the contact friction between the brake disc and the brake shoe is transmitted to the core of the paper roll via the paper roll supporting member to brake the revolution of the paper roll.

With this arrangement, however, the braking force has to be adjusted only by adjusting the contact friction between the brake disc and the brake shoe, regardless of changes in the diameter of the paper roll ranging from a relatively large diameter of a new roll to a smaller diameter immediately before it is used up and spliced to a new one. Consequently, it is extremely difficult to meticulously adjust the tension of the traveling web by braking the revolution of the paper roll whose diameter is reduced gradually in the course of operation.

That is, it is impossible to finely adjust the force of forcing the brake shoe to the brake disc so as to match with the changing rotating inertia of the paper roll whose diameter is gradually reduced in the course of operation. This has led to hunting in the traveling tension of the web; too strong or too weak tension, making the traveling tension unstable and involving much time to stabilize the tension.

In the paper roll braking device of ② whose specific construction is not disclosed, the adjusting accuracy of the traveling tension of the traveling web paid off from the paper roll is not necessarily clear. Broadly speaking, this paper roll braking device forces a lining belt onto the outer periphery of the paper roll to use the contact friction between the lining belt and the paper roll to brake the revolution of the paper roll. The force required for braking differs depending on the type of paper roll, particularly on difference in the surface properties of paper. With paper having an extremely slick or coarse surface, furthermore, it is difficult to satisfactorily adjust the traveling tension of the web. Another shortcoming of this type of paper roll braking device is deterioration of the quality of printed matter due to the damage to the lining belt caused by friction with the surface of the web paid off from the paper roll.

The paper roll braking device of ③ brakes the revolution of the paper roll by forcing a braking belt onto the outer periphery of the paper roll, using the contact friction between the braking belt and the paper roll until the diameter of the paper roll is reduced to a predetermined diameter, and by forcing the same brake shoe onto a brake disc fitted to a paper roll supporting shaft to transmit the braking force to the core of the paper roll via the paper roll supporting shaft relying on the contact friction between the brake disc and the brake shoe after the diameter of the paper roll becomes smaller than a predetermined diameter.

Consequently, the paper roll braking device of ③ can solve the problem inherent in the paper roll braking device of ①, but cannot resolve the problem inherent in the paper roll braking device of ②. With this device, it is necessary to change over the braking force imparting mechanism for separating the brake belt from the outer periphery and forcing the brake shoe onto the brake disc when the diameter of the paper roll reaches a predetermined value. At this time, however, both the mechanism may be operated simultaneously or disengaged simultaneously, making the traveling tension of the web extremely unstable.

The present invention is intended to overcome these drawbacks by providing a paper roll braking device that makes it possible to meticulously adjust and quickly stabilize the traveling tension of a web paid off from a paper roll by meticulously braking the revolution of the paper roll regardless of the diameter of the paper roll, so that no damage is caused on the surface of the web paid off from the paper roll, and the braking force of the paper roll is prevent from unwantedly increasing or totally disappearing.

SUMMARY OF THE INVENTION

It is an object of the present invention to provide a paper roll braking device that makes it possible to meticulously adjust and quickly stabilize the traveling tension of a web paid off from a paper roll by meticulously braking the revolution of the paper roll regardless of the diameter of the paper roll, so that no damage is caused on the surface of the web paid off from the paper roll, and the braking force of the paper roll is prevent from unwantedly increasing or totally disappearing.

It is another object of the present invention to provide an engage/disengage changeover section suitable for causing each friction disc in the braking section to engage with and disengage from both sides of rotors.

It is still another object of the present invention to provide a contact pressure adjusting section that can correct and change the contact pressure of the friction discs to the rotors via the engage/disengage changeover section in accordance with a signal generated by an operation control section.

It is a further object of the present invention to provide a contact pressure adjusting section that controls the traveling tension of a web during normal operation of a rotary press, and can control for emergency stop in a failure of the rotary press.

It is still a further object of the present invention to provide an outside diameter detecting section that detects the outside diameter of a paper roll during operation.

It is still a further object of the present invention to provide an operation control section that generates a correction signal for preventing the slack of the web.

It is still a further object of the present invention to provide an operation control section that generates a splicing signal for splicing a traveling web to a new paper roll to ensure continuous printing.

In disclosed embodiments, a paper roll braking device for rotary presses, in which a web is paid off from a paper roll supported between frames and caused to travel to be printed in printing units, comprising a braking section having rotors provided on paper roll supporting members and frictional discs that are provided at a plurality of locations along the outer periphery of the rotors and can be engaged with and disengaged from the rotors at their respective locations, an engage/disengage changeover section for controlling the engage/disengage operation of the friction discs to the rotors, a contact pressure adjusting section having a tension sensing mechanism for sensing changes in the traveling tension of the web for adjusting the contact pressure of the friction discs to the rotors, an outside diameter detecting section for detecting the outside diameter of the paper roll, an operation controlling section for changing over the engage/disengage changeover section when the paper roll outside diameter detected by the outside diameter detecting section reaches a predetermined diameter.

DETAILED DESCRIPTION OF PREFERRED EMBODIMENTS

In the following, embodiments of the present invention will be described, referring to the accompanying drawings. Prior to the description of FIGS. 1 and 2, an example of a rotary press in which the paper roll braking device according to the present invention is used, as shown in FIG. 3 will be described.

Figure 3:
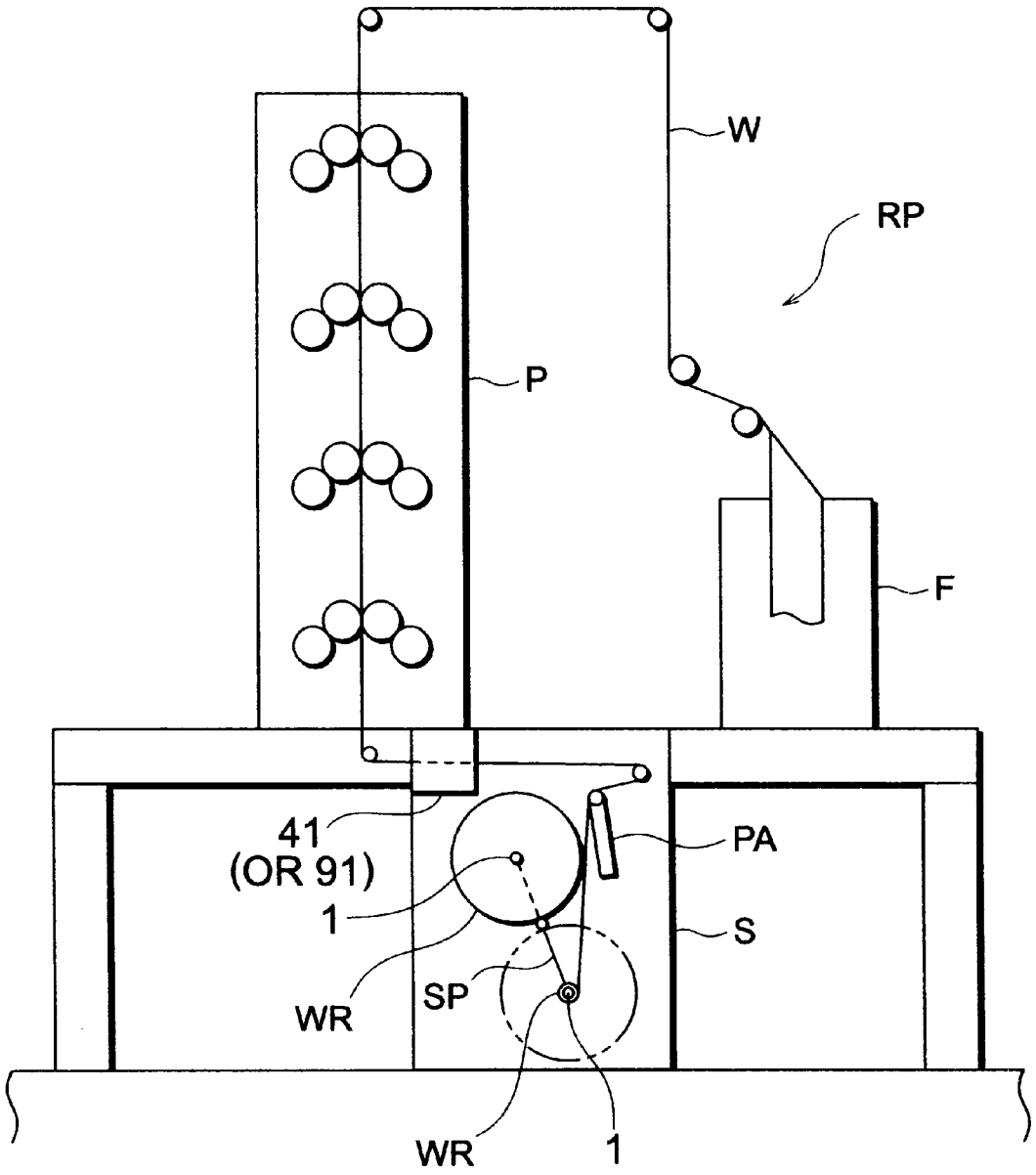
FIG. 3 is a schematic diagram illustrating an example of a rotary press in which the paper roll braking device according to the present invention is used.

In FIG. 3, a rotary press RP has at least one unit of a paper feeding unit S, a printing unit P, a processing unit that is a folding unit, for example. A paper web W is paid off from a paper roll mounted on the paper feeding unit S, caused to travel to the processing unit F via the printing unit P so that the web W is printed in the printing unit P and processed (cut and folded in this embodiment) in the processing unit F to produce printed matter.

The paper feeding unit S has a paper roll supporting section SP to which two paper rolls WR and WR can be loaded, and a splicing means PA for spicing an end of a traveling paper web W paid off from one paper roll WR to an end of another web of the other paper roll WR before the traveling web WR is used up. Consequently, the rotary press RP continuously pays off a web W sequentially from the two paper rolls WR and WR, and causes the web W to travel to produce printed matter continuously.

On the paper roll supporting section SP rotatably provided are two sets of supporting members 1 and 1 that face each other on the same axial line (only one set of them are shown in FIG. 3); each set of the supporting members 1 and 1 supporting the paper roll WR at the both ends thereof.

A braking section 2, which will be described later in reference to FIGS. 1 and 2, for example, is fitted to one end each of the supporting members 1 and 1. In the traveling path of the web W from the paper feeding unit S to the printing unit P provided is a tension sensor 41 (FIG. 1) or an angle displacement arm 91 (FIG. 2) that is a tension sensing mechanism for sensing changes in the traveling tension of the web W, which will be described later in reference to FIGS. 1 and 2, for example.

The first embodiment of the paper roll braking device installed on the rotary press RP will be described in the following, referring to FIG. 1.

Figure 1:
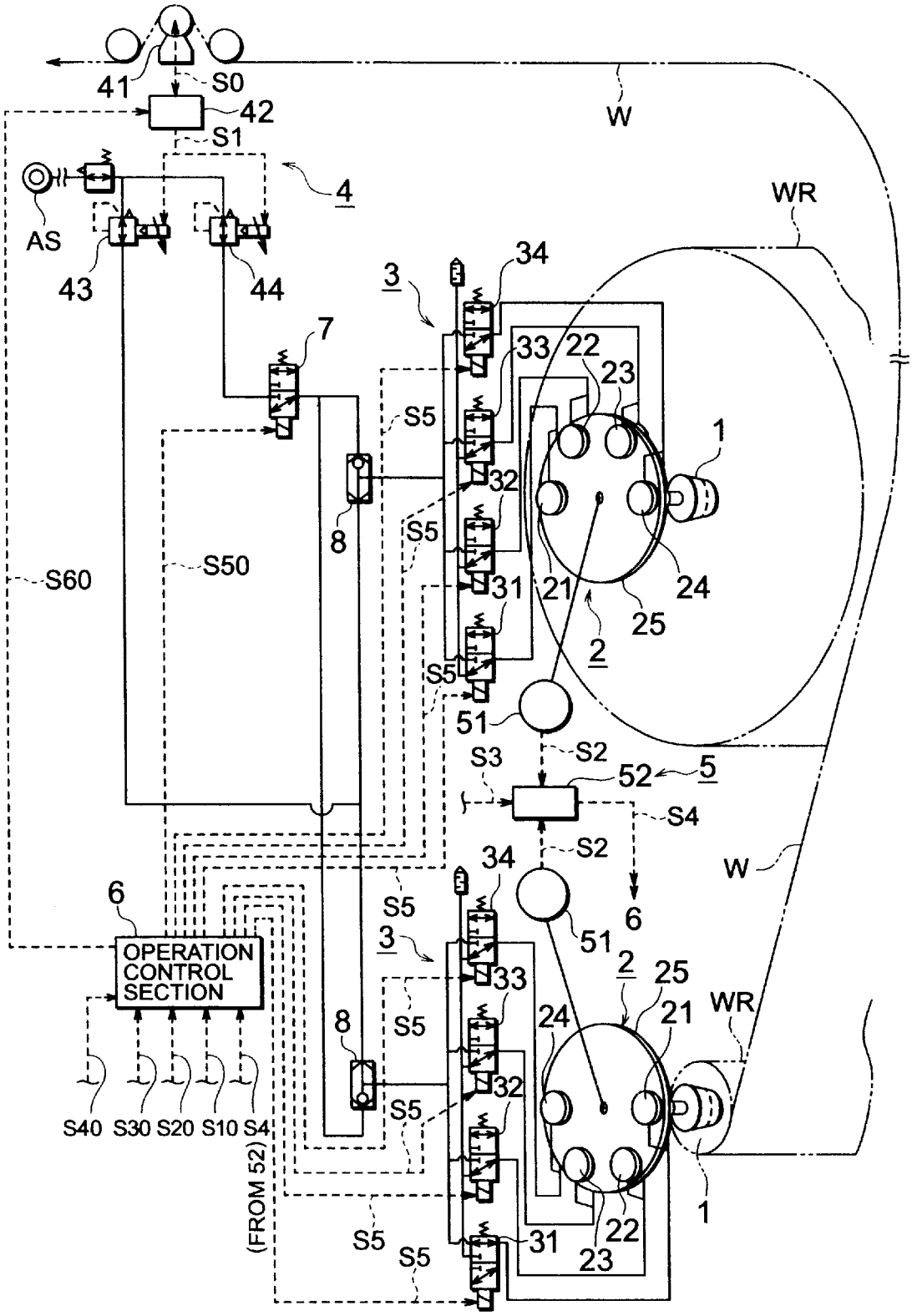
FIG. 1 is a schematic diagram illustrating a paper roll braking device embodying the present invention.

In FIG. 1, the paper roll braking device comprises a braking section 2, an engage/disengage changeover section 3, a contact pressure adjusting section 4, an outside diameter detecting section 5 and an operation control section 6.

The braking section 2 comprises two sets of supporting members 1 and 1 that form the paper roll supporting members SP, rotors 25 that are rotatable together with the supporting member 1, and fitted to one end each, opposite to the paper roll supporting side, of the supporting members 1 and 1, and a plurality of pairs (4 pairs in the embodiment shown in FIG. 1) of friction discs 21, 22, 23 and 24 provided facing each other with each rotor 25 interposed therebetween in such a manner that the friction discs 21, 22, 23 and 24 can be engaged with and disengaged from both sides of the rotors 25 by a drive unit operated by fluid pressure, such as pneumatic pressure.

The engage/disengage changeover section 3 has solenoid valves 31, 32, 33 and 34 that can switch over the supply of fluid pressure to the drive unit (not shown, and hereinafter referred to as "friction disc drive unit") for driving the friction discs 21, 22, 23 and 24 of the braking section 2 to cause them to engage with and disengage from both sides of the rotor 25.

The contact pressure adjusting section 4 comprises a tension sensor 41 as a tension sensing mechanism for sensing changes in the traveling tension of the web W that travels during operation of the rotary press RP and converting the changes into a tension signal S0 (S in S0 shown in FIG. 1 represents a signal. The same applies to all symbols prefixed with S used throughout the figure, and in FIG. 2 as well.) and generating it as an output, a tension control signal output means 42 for generating a tension control signal S1 corresponding to the tension signal S0 produced by the tension sensor 41, and electric-pneumatic converters 43 and 44 provided in a fluid pressure supply pipe line between the fluid pressure supply source AS and the engage/disengage changeover section 3 for changing fluid pressure, such as pneumatic pressure, supplied from the fluid pressure supply source AS to the friction disc drive units of the braking section 2 via the engage/disengage changeover section 3 in accordance with the tension control signal S1, so that the contact pressure of the friction discs 21, 22, 23 and 124 can be adjusted to maintain the traveling tension of the web W within an almost constant range.

The outside diameter detecting section 5 comprises a rotation signal output means 51 for generating a rotation signal S2 as an electrical signal proportional to the rotational speed of the supporting member 1, and a predetermined diameter signal output means 52 that receives a rotation signal S2 and a rotary press operation signal S3, detects the outside diameter of the paper roll WR from which the traveling web W is paid off based on the operation speed of the rotary press and the rotational speed of the supporting member 1, and generates a predetermined diameter signal S4 when the outside diameter of the paper roll WR reaches a predetermined size.

The operation control section 6 comprises an operation control section 6 that is connected to the predetermined diameter signal output means 52 of the outside diameter detecting section 5, and when a predetermined diameter signal S4 is produced, transmits an operation signal S5 to some of the solenoid valves 31, 32, 33 and 34 of the engage/disengage changeover section 3 to cause the friction discs 21, 22, 23 and 24 to disengage from the rotor 25 in accordance with the predetermined diameter signal S4.

The paper roll braking device according to the present invention having the aforementioned construction is operated as follows:

When a rotary press operation signal S10 of PRINT START is entered in the operation control section 6, the operation control section 6 demagnetizes the electromagnet parts of the solenoid valves 31, 32, 33 and 34 provided in the fluid pressure supply pipe line between the fluid pressure supply source AS and the friction disc drive units so that all the friction discs 21, 22, 23 and 24 of the braking section 2 provided on a set of the supporting members 1 and 1 supporting the paper roll WR from which the web W is paid off in the course of printing operation among the braking sections provided for each of the two sets of the supporting members 1 and 1 of the paper roll supporting section SP are caused to come in contact with the rotor 25.

The operation control section 6 transmits an operation signal S50 to the solenoid valve 7 provided in the fluid pressure supply pipe line between the electric-pneumatic converter 44, which will be described later, to excite electromagnet part thereof to change over the solenoid valve 7.

With this, a fluid whose pressure is set by the electric-pneumatic converter 43 is fed to the solenoid valves 31, 32, 33 and 34, as will be described later, and the paper roll WR from which the web W is paid off in the course of printing operation is rotated while being braked with the frictional force caused by the contact friction between the friction discs 21, 22, 23 and 24 as the web W is caused to travel during printing operation. The braking force to the rotation of the paper roll WR caused by the frictional force due to the contact friction between the friction discs 21, 22, 23 and 24 and the rotor 25 produces a traveling tension on the traveling web W.

The traveling tension generated on the web W is detected by the tension sensor 41 of the contact pressure adjusting section 4, converted into a tension signal S0 in accordance with its size, and transmitted to the tension control signal output means 42. The tension control signal output means 42, to which the tension signal S0 in accordance with the size of the tension is entered, transmits an appropriate tension control signal S1 in accordance with the size of the tension to the electric-pneumatic converters 43 and 44 provided in the fluid pressure supply pipe line between the fluid pressure supply source As and the solenoid valves 31, 32, 33 and 34. The electric-pneumatic converters 43 and 44 adjust and set the fluid pressure fed to the solenoid valves 31, 32, 33 and 34 to a fluid pressure in accordance with the aforementioned tension control signal S1.

The electric-pneumatic converter 43 sets a fluid pressure to control the traveling tension of the web W during normal operation of the rotary press RP, while the electric-pneumatic converter 44 sets a fluid pressure higher than the fluid pressure set by the electric-pneumatic converter 43 to prepare for an emergency stop as needed in a failure of the rotary press. The fluid whose pressure is adjusted by the electric-pneumatic converters 43 and 44 is fed to the solenoid valves 31, 32, 33 and 34 and to the friction disc drive units via a shuttle valve 8.

Since the upstream fluid pressure supply pipe line is disconnected from the downstream fluid pressure supply pipe line as the electromagnet part of the solenoid valve 7 is excited, as described above, in the normal operation of the rotary press RP, the fluid pressure set by the electric-pneumatic converter 43 is supplied to the friction disc drive units, and as a result, the rotation of the paper roll WR is braked so that the traveling tension of the web W is maintained with a predetermined proper range.

As the paper roll WR is rotated, moreover, the rotation signal output means 51, such as a rotary encoder, connected to the supporting member 1 generates a rotation signal S2 proportional to the rotational speed of the paper roll WR. Furthermore, the predetermined diameter signal output means 52 to which the rotary press operation speed signal S3 is entered, together with the rotation signal S2 keeps detecting the outside diameter of the paper roll WR based on the rotation signal S2 and the operation signal S3.

The paper roll WR is consumed as the web W is paid off from the paper roll WR in the course of printing operation. When the predetermined diameter signal output means 52 detects that the paper roll WR reaches a first predetermined diameter D1, the predetermined diameter signal output means 52 transmits a predetermined diameter signal, that is, a first predetermined diameter signal S4 to the operation control section 6. As the operation control section 6 receives the first predetermined diameter signal S4, a control signal S5 is generated to the engage/disengage changeover section 3 of the braking section of the supporting members 1 and 1 supporting the paper roll WR from which the current web W is paid off, so that the electromagnet parts of the solenoid valves 31 and 32 are excited to change over the solenoid valves 31 and 32 to disengage the friction discs 21 and 22 from the rotor 25.

The operation control section 6 transmits a predetermined correction signal, that is, a first correction signal S60 for correcting the tension control signal S1 that is being generated by the tension control signal output means 42 to the tension control signal output means 42, together with the control signal S5. The first correction signal S60 adjusts the fluid pressure set by the electric-pneumatic converters 43 and 44 to cope with a reduction in the braking force to the rotation of the paper roll WR caused in a moment the friction disc 23 of the braking section 2 is disengaged from the rotor 25, so that the web W is prevented from being slackened due to a great fluctuation in the traveling tension of the web W.

The paper roll WR whose outside diameter is reduced to less than the first predetermined diameter D1 is kept consumed as the rotation thereof is braked by the friction between the friction discs 23 and 24 and the rotor 25. As the predetermined diameter signal output means 52 detects that the paper roll WR reaches the second predetermined diameter D2(D2<D1), at which the paper roll WR is ready for splicing, the predetermined diameter signal output means 52 transmits the second predetermined diameter signal S4 again to the operation control section 6.

Upon receipt of the second predetermined diameter signal S4, the operation control section 6 transmits a control signal S5 to the engage/disengage changeover section 3 of the braking section 2 on the supporting members 1 and 1 supporting the paper roll WR from which the web W is currently paid off to change over the solenoid valve 33, for example, by exciting the electromagnet part of the solenoid valve 33, thereby disengaging the friction disc 23 from the rotor 25. In addition to the control signal S5, the operation control section 6 transmits to the tension control signal output means 42 a predetermined correction signal for correcting the tension control signal S1 that is currently being generated, that is a second correction signal S60.

The second correction signal S60 adjusts the fluid pressure set by the electric-pneumatic converters 43 and 44 to cope with a reduction in the braking force to the rotation of the paper roll WR caused in a moment the friction disc 23 of the braking section 2 is disengaged from the rotor 25, so that the web W is prevented from being slackened due to a great fluctuation in the traveling tension of the web W.

As the paper roll WR reaches a splicing-ready diameter D3(D3<D2<D1), the paper roll supporting section SP is caused to move to a splicing-ready position shown in FIGS. 1 and 3. The operation control section 6 transmits a control signal S5 to the engage/disengage changeover section 3 of the braking section 2 that is currently braking the rotation of the paper roll WR from which the web W is not currently paid off to excite the electromagnet parts of the solenoid valves 31, 32, 33 and 34 of the engage/disengage changeover section 3, thereby causing the friction discs 21, 22, 23 and 24 to disengage from the rotor 25. Then, the paper roll WR from which the web W is not currently paid off is caused to rotate by an appropriate means (not shown) so that the peripheral rotational speed thereof agrees with the traveling speed of the paper roll W that is now traveling. Since the method of causing the paper roll W from which the web W is not currently paid off is out of scope of the present invention, further description of the method is omitted.

When the peripheral rotational speed of the paper roll WR from which the web W is not currently paid off agrees with the traveling speed of the web W that is now traveling, a splicing signal is generated at a predetermined timing from an appropriate device. Based on the splicing signal, the traveling web W is forced onto the peripheral surface of the paper roll WR from which the web W is not currently paid off, and spliced to the traveling web W at the paste-coated area at an end of the web W, and the web W that has been traveling is cut off at the upstream side from the splicing position by a cutter. Thus, the splicing operation is completed.

A signal to operate the cutter, on the other hand, is entered into the operation control section 6 as a splicing-end signal S20.

Upon receipt of the spicing-end signal S20, the operation control section 6 demagnetizes the electromagnet parts of the solenoid valves 31, 32, 33 and 34 each of the two engage/disengage changeover sections 3 to cause the friction discs 21, 22, 23 and 24 each of the braking sections 2 and 2 to come in contact with the rotor 25.

With the above process, the rotation of the paper roll WR from which a web W has been newly paid off after splicing is braked by the braking section 2 provided on the supporting member 1, so that the traveling tension of the traveling web W is properly adjusted by the aforementioned control via the contact pressure adjusting section 4.

The paper roll WR from which the web W stopped being paid off after splicing is stopped rotating by the braking operation of the braking section 2 provided on the supporting member 1. When the continuation of printing requires a new paper roll WR to be supplied, the paper roll WR that had stopped rotating is removed and replaced with a new paper roll WR.

To change paper rolls WR, the braking section 2 on the supporting section 1 on the side of the paper roll WR that is to be replaced can be changed over to a desired state by manually entering the braking section manual signal S40 into the operation control section 6.

In order to end the printing operation of the rotary press RP, the aforementioned braking control is carried out during the period in which the rotary press RP is decelerated to a halt to maintain the traveling tension of the web W is kept in a predetermined range. When a rotary press stop signal S10 for stopping the rotary press RP is entered into the operation control section 6, the electromagnet parts of the solenoid valves 31, 32, 33 and 34 each of the two engage/disengage changeover sections 3 and 3 are demagnetized, bringing all the friction discs 21, 22, 23 and 24 each of the braking sections 2 and 2 in contact with the rotor 25, thereby stopping the rotation of the paper roll WR simultaneously with the stop of the rotary press RP.

When an emergency stop signal S30 for emergency stopping the rotary press RP is entered into the operation control section 6 in a failure of the rotary press RP, the operation control section 6 demagnetizes the electromagnet parts of the solenoid valves 31, 32, 33 and 34 each of the two engage/disengage changeover sections 3 and 3, and also demagnetizes the electromagnet parts of a solenoid valve 7 provided on a fluid pressure supply pipe line between the electric-pneumatic converter 44 and the shuttle valve 8, allowing a higher fluid pressure set by the electric-pneumatic converter 44 to be fed to the friction disc drive units en bloc to forcibly stop the paper roll WR simultaneously with the emergency stop of the rotary press RP.

Figure 2:
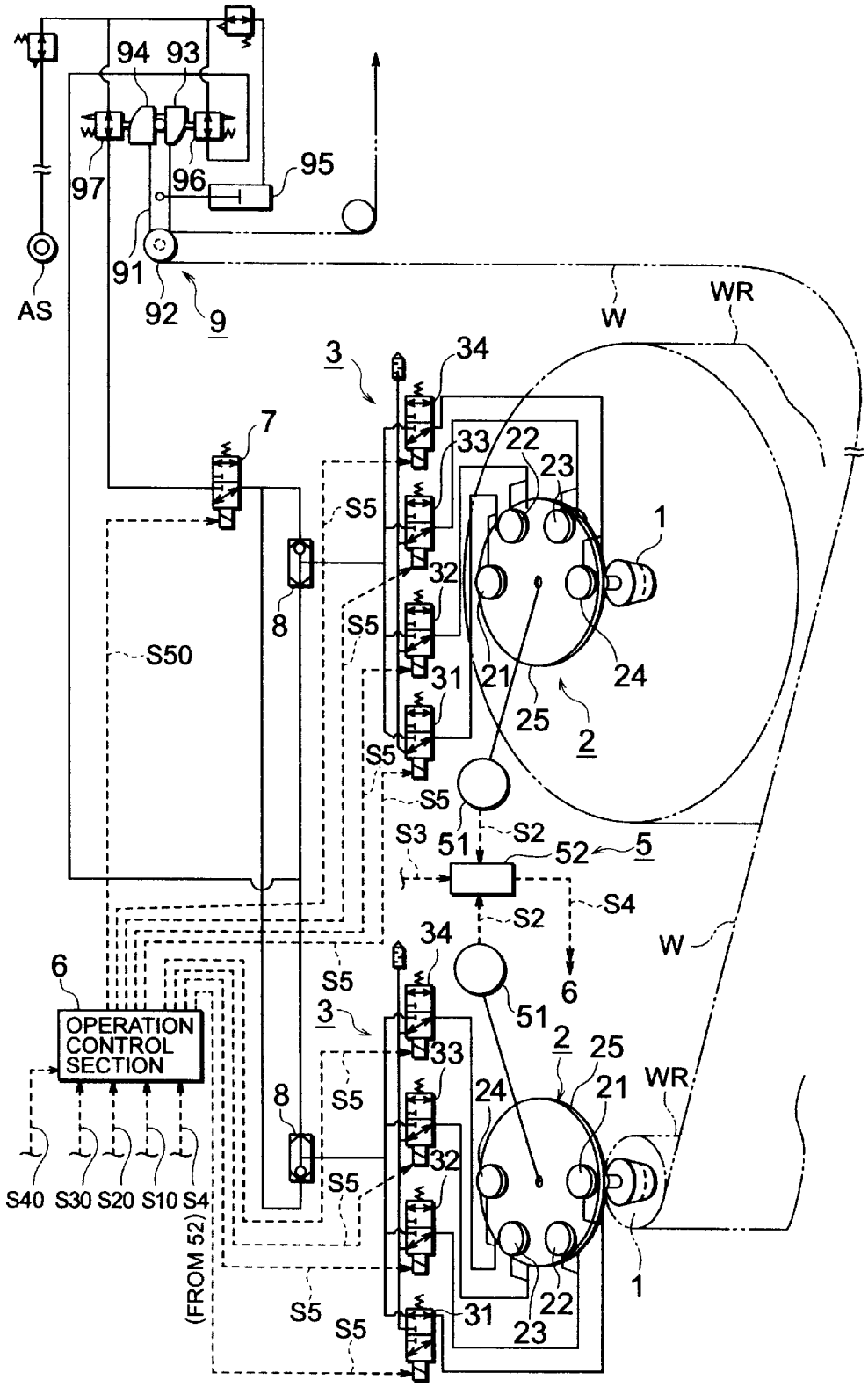
FIG. 2 is a schematic diagram illustrating another embodiment of the paper roll braking device according to the present invention.

FIG. 2 is a schematic diagram of another example of the paper roll braking device according to the present invention.

In the figure, like parts are indicated by like numerals used in FIG. 1, and the only difference between FIGS. 1 and 2 is a contact pressure adjusting section 9.

The contact pressure adjusting section 9 shown in FIG. 2 comprises an angular displacement arm 91 that is angularly displaceable and imparted by a fluid pressure cylinder 95 a force resisting to the traveling tension of the web W during the operation of the rotary press RP, a guide roller 92 rotatably provided at a free end of the angular displacement arm 91 and outer peripheral cams 93 and 94 that displaces following the angular displacement of the angular displacement arm 91, and displacement rod type regulators 96 and 97 provided in a fluid pressure supply pipe line between a fluid pressure supply source AS and an engage/disengage changeover section 3 in such a manner that the displacement rod thereof is brought into contact with the outer peripheral cams 93 and 94; the displacement rod thereof being operated by the displacement of the outer peripheral cams 93 and 94 caused as a result of the angular displacement of the angular displacement arm 91 so that the fluid pressure, such as air pressure, supplied from the fluid pressure supply source AS to the friction disc drive unit of the braking section 2 via the engage/disengage changeover section 3 can be changed by the operation of the displacement rod. With this arrangement, the contact pressure adjusting section 9 can adjust the contact pressure of the friction discs 21, 22, 23 and 24 with the rotor 25 so that the traveling tension of the web W can be changed in an almost constant range.

The angular displacement arm 91 in the contact pressure adjusting section 9 forms a tension sensing mechanism that senses changes in the traveling tension of the web W with the degree of angular displacement as a balance between the traveling tension of the web W and the force of the fluid pressure cylinder 95.

The operation of the paper roll braking device shown in FIG. 2 having the aforementioned contact pressure adjusting section 9 is as follows:

When a PRINT START rotary press operation signal S10 is entered into the operation control section 6, the operation control section 6 demagnetizes the electromagnet parts of the solenoid valves 31, 32, 33 and 34 provided in the fluid pressure supply pipe line between the fluid pressure supply source AS and the friction disc drive units so that all the friction discs 21, 22, 23 and 24 of at least the braking section 2 provided on a set of the supporting members 1 and 1 supporting the paper roll WR from which the web W is paid off during printing, among the braking sections 2 provided on each set of the two sets of the supporting members 1 and 1 for the paper roll WR and the supporting section SP, can be brought in contact with the rotor 25.

The operation control section 6 transmits an operation signal S50 to the solenoid valve 7 provided in the fluid pressure supply pipe line between the displacement rod type regulator 97, which will be described later, and the shuttle valve 8 to excite the electromagnet part thereof to change over the solenoid valve 7.

This allows the fluid whose pressure is set by the displacement rod type regulator 96, which will be described later, to be fed to the solenoid valves 31, 32, 33 and 34, and as a result, at least the paper roll WR from which the web W is paid off during printing operation is caused to rotate while being braked by the frictional force caused by the contact friction between the friction discs 21, 22, 23 and 24 and the rotor 25 as the web W is caused to travel during printing. The braking force to the rotation of the paper roll WR as the frictional force by the contact friction between the friction discs 21, 22, 23 and 24 and the rotor 25 generates a traveling tension on the traveling web W.

The traveling tension produced on the web W is detected by the angular displacement arm 91 of the contact pressure adjusting section 9, and the angular displacement arm 91 is angularly displaced in accordance with the size of the tension. This in turn causes an angular displacement of the outer peripheral cams 93 and 94. The outer peripheral cams 93 and 94 angularly displaced in accordance with the size of the tension actuate via the cam surfaces thereof the displacement rods of the displacement rod type regulators 96 and 97 provided in the fluid pressure supply pipe line between the fluid pressure supply source AS and the solenoid valves 31,32, 33 and 34. The displacement rod type regulators 96 and 97 adjust and set the fluid pressure supplied to the solenoid valves 31, 32, 33 and 34 to a fluid pressure corresponding to the displacement of the displacement rods.

The displacement rod type regulator 96 sets the fluid pressure for controlling the traveling tension of the web W during the normal operation of the rotary press RP, while the displacement rod type regulator 97 sets a higher fluid pressure than the fluid pressure set by the displacement rod type regulator 96 in preparation for an emergency stop at the time of a failure of the rotary press RP.

The fluid whose supply pressure is adjusted and set by the displacement rod type regulators 96 and 97 is supplied to the solenoid valves 31, 32, 33 and 34 and to the friction disc drive units via the shuttle valve 8.

Since the electromagnet part of the solenoid valve 7 is excited to cut off the upstream and downstream fluid pressure supply pipe lines during the normal operation of the rotary press RP, the fluid pressure set by the displacement rod type regulator 96 is supplied to the fiction disc drive units, and thereby the rotation of the paper roll WR is braked so that the traveling tension of the web W can be kept within a predetermined proper range.

With the rotation of the paper roll WR, a rotation signal output means 51 that is a rotary encoder, for example, connected to the supporting member 1 generates a rotation signal S2 proportional to the rotating speed of the paper roll WR. Furthermore, a predetermined diameter signal output means 52 to which a rotary press operating speed signal S3 is entered, together with the rotation signal S2 keeps detecting the outside diameter of the paper roll WR based on the rotation signal S2 and the rotary press operating speed signal S3.

As printing proceeds and the web W is paid off, the paper roll WR is consumed. And, when the predetermined diameter signal output means 52 detects that the paper roll WR reaches a first predetermined diameter D1, then the predetermined diameter signal output means 52 transmits a predetermined diameter signal, that is, a first predetermined diameter signal S4 to the operation control section 6. Upon receipt of the first predetermined diameter signal S4, the operation control section 6 transmits a control signal S5 to the engage/disengage changeover section 3 of the braking section 2 on the supporting members 1 and 1 supporting the paper roll WR from which the web W is currently being paid off to excite the electromagnet parts of the solenoid valves 31 and 32, for example, changing over the solenoid valves 31 and 32 to disengage the friction discs 21 and 22 from the rotor 25.

In the course of disengagement of the friction discs 21 and 22 of the braking section 2 from the rotor 25, the braking force to the rotation of the paper roll WR is momentarily reduced, but the angular displacement arm 91 copes with the reduction in braking force by angular displacement, absorbing the slack of the web W, and the outer peripheral cams 93 and 94 are also angularly displaced along with the angular displacement of the angular displacement arm 91, actuating the displacement rods of the displacement rod type regulators 96 and 97 to adjust the fluid pressure set by the displacement rod type regulators 96 and 97. Thus, the traveling tension of the web W is prevented from fluctuating greatly.

After the outside diameter of the paper roll WR has been reduced to less than the first predetermined diameter D1, the paper roll WR is kept consumed as the rotation thereof is braked by the frictional force between the friction discs 23 and 24 and the rotor 25. When the predetermined diameter signal output means 52 detects that the paper roll WR reaches a splicing-ready second predetermined diameter D2 (D2<D1), the predetermined diameter signal output means 52 transmits a second predetermined diameter signal S4 to the operation control section 6.

Upon receipt of the second predetermined diameter signal S4, the operation control section 6 transmits a control signal S5 to the engage/disengage changeover section 3 of the braking section 2 on the supporting members 1 and 1 supporting the paper roll WR from which the web W is currently paid off to change over the solenoid valve 33, for example, by exciting the electromagnet part of the solenoid valve 33, thereby disengaging the friction disc 23 from the rotor 25.

In the course of disengagement of the friction discs 21 and 22 of the braking section 2 from the rotor 25, the braking force to the rotation of the paper roll WR is momentarily reduced, but the angular displacement arm 91 copes with the reduction in braking force by angular displacement, absorbing the slack of the web W, and the outer peripheral cams 93 and 94 are also angularly displaced along with the angular displacement of the angular displacement arm 91, actuating the displacement rods of the displacement rod type regulators 96 and 97 to adjust the fluid pressure set by the displacement rod type regulators 96 and 97. Thus, the traveling tension of the web W is prevented from fluctuating greatly, as in the case of the first predetermined diameter, described above.

As the paper roll WR reaches a splicing-ready diameter D3(D3<D2<D1), the paper roll supporting section SP is caused to move to a splicing-ready position shown in FIGS. 2 and 3. The operation control section 6 transmits a control signal S5 to the engage/disengage changeover section 3 of the braking section 2 that is currently braking the rotation of the paper roll WR from which the web W is not currently paid off to excite the electromagnet parts of the solenoid valves 31, 32, 33 and 34 of the engage/disengage changeover section 3, thereby causing the friction discs 21, 22, 23 and 24 to disengage from the rotor 25. Then, the paper roll WR from which the web W is not currently paid off is caused to rotate by an appropriate means (not shown) so that the peripheral rotational speed thereof agrees with the traveling speed of the paper roll W that is now traveling. Since the method of causing the paper roll W from which the web W is not currently paid off is out of scope of the present invention, further description of the method is omitted.

When the peripheral rotational speed of the paper roll WR from which the web W is not currently paid off agrees with the traveling speed of the web W that is now traveling, a splicing signal is generated at a predetermined timing from an appropriate device. Based on the splicing signal, the traveling web W is forced onto the peripheral surface of the paper roll WR from which the web W is not currently paid off, and spliced to the traveling web W at the paste-coated area at an end of the web W, and the web W that has been traveling is cut off at the upstream side from the splicing position by a cutter. Thus, the splicing operation is completed.

A signal to operate the cutter, on the other hand, is entered into the operation control section 6 as a splicing-end signal S20.

Upon receipt of the spicing-end signal S20, the operation control section 6 demagnetizes the electromagnet parts of the solenoid valves 31, 32, 33 and 34 each of the two engage/disengage changeover sections 3 to cause the friction discs 21, 22, 23 and 24 each of the braking sections 2 and 2 to come in contact with the rotor 25.

With the above process, the rotation of the paper roll WR from which a web W has been newly paid off after splicing is braked by the braking section 2 provided on the supporting member 1, so that the traveling tension of the traveling web W is properly adjusted by the aforementioned control via the contact pressure adjusting section 4.

The paper roll WR from which the web W stopped being paid off after splicing is stopped rotating by the braking operation of the braking section 2 provided on the supporting member 1. When the continuation of printing requires a new paper roll WR to be supplied, the paper roll WR that had stopped rotating is removed and replaced with a new paper roll WR.

To change paper rolls WR, the braking section 2 on the supporting section 1 on the side of the paper roll WR that is to be replaced can be changed over to a desired state by manually entering the braking section manual signal S40 into the operation control section 6.

In order to end the printing operation of the rotary press RP, the aforementioned braking control is carried out during the period in which the rotary press RP is decelerated to a halt to maintain the traveling tension of the web W is kept in a predetermined range. When a rotary press stop signal S10 for stopping the rotary press RP is entered into the operation control section 6, the electromagnet parts of the solenoid valves 31, 32, 33 and 34 each of the two engage/disengage changeover sections 3 and 3 are demagnetized, bringing all the friction discs 21, 22, 23 and 24 each of the braking sections 2 and 2 in contact with the rotor 25, thereby stopping the rotation of the paper roll WR simultaneously with the stop of the rotary press RP.

When an emergency stop signal S30 for emergency stopping the rotary press RP is entered into the operation control section 6 in a failure of the rotary press RP, the operation control section 6 demagnetizes the electromagnet parts of the solenoid valves 31, 32, 33 and 34 each of the two engage/disengage changeover sections 3 and 3, and also demagnetizes the electromagnet parts of a solenoid valve 7 provided on a fluid pressure supply pipe line between the electric-pneumatic converter 44 and the shuttle valve 8, allowing a higher fluid pressure set by the electric-pneumatic converter 44 to be fed to the friction disc drive units en bloc to forcibly stop the paper roll WR simultaneously with the emergency stop of the rotary press RP.

Needless to say, the present invention is not limited to the aforementioned embodiments, but may be of such a construction that the paper roll supporting section can accommodate more than two paper rolls. The number of friction discs that can engage with, or disengage from, the rotor is not limited to four. The tension sensing mechanism may be of any construction so long as it does some work in response to the traveling tension of the traveling web.

Furthermore, the outside diameter detecting section may be of such a construction that a signal is generated as the outside diameter of the paper roll is directly detected with reflection-type or transmission-type phototubes disposed facing each other at the position of the first predetermined diameter and that of the second predetermined diameter on the end face of the paper roll, for example.

As described above, the present invention makes it possible to quickly stabilize the traveling tension of the web since the traveling tension of the web paid off from the paper roll can be meticulously adjusted, including at the time of paper roll changeover, by meticulously braking the rotation of the paper roll regardless of the diameter thereof, ranging from the paper roll of a large diameter to that of a small diameter. In addition, since no force is exerted on the surface of the paper roll in accomplishing the aforementioned braking, no damage is caused on the surface of the web paid off from the paper roll.

Furthermore, when the braking force for braking the paper roll is changed over in accordance with a reduction in the outside diameter of the paper roll, the number of friction discs that generate a braking force in contact with the rotor can be gradually reduced, the braking force to the rotation of the paper roll is prevented from being unwantedly fluctuated. Thus, the traveling tension of the traveling web paid off from the paper roll can be kept in a proper and stable state at all times.

What is claimed is:

1. A paper roll braking device for rotary presses, in which a web is paid off from a paper roll supported between frames, caused to travel and printed in a printing unit, comprising:

braking sections provided at a plurality of locations along the outer periphery of a rotor provided on a supporting member for supporting the paper roll and equipped with friction discs that can be engaged with and disengaged from the rotor at each location, engage/disengage changeover sections for controlling the engaging/disengaging operation of the friction discs with respect to the rotor, a contact pressure adjusting section having a tension sensing mechanism for sensing a change in the traveling tension of the web and adjusting the contact pressure of the friction discs with the rotor via the engage/disengage changeover section in accordance with the change in the traveling tension of the web detected by the tension sensing mechanism, an outside diameter detecting section for detecting the outside diameter of the paper roll, and an operation control section for at least changing over the engage/disengage changeover section when the outside diameter of the paper roll detected by the outside diameter detecting section reaches a predetermined diameter.

2. A paper roll braking device as set forth in claim 1 wherein the engage/disengage changeover section has solenoid valves for causing the friction discs of the braking section to engage with and disengage from both sides of the rotor.

3. A paper roll braking device as set forth in claim 1 wherein the contact pressure adjusting section can change the contact pressure of the friction discs with the rotor via the engage/disengage changeover section in accordance with a signal transmitted by the operation control section.

4. A paper roll braking device as set forth in claim 1, wherein the contact pressure adjusting section comprises a tension sensing mechanism that is a tension sensor for detecting changes in the traveling tension of the web, and an electric-pneumatic converter in fluid communication with the engage/disengage changeover section for changing a fluid pressure supplied by a fluid pressure supply source in accordance with the changes in the traveling tension detected by the tension sensing mechanism.

5. A paper roll braking device as set forth in claim 4 wherein the electric-pneumatic converter comprises an electric-pneumatic converter part for setting a fluid pressure for controlling the traveling tension of the web during the normal operation of the rotary press, and another electric-pneumatic converter part for setting a higher fluid pressure for the emergency stop of the rotary press.

6. A paper roll braking device as set forth in claim 1, wherein the contact pressure adjusting section has a tension sensing mechanism comprising an angular displacement arm having a rotatable guide roller for guiding the web, a fluid pressure cylinder for imparting a force resisting the traveling tension of the traveling web to the angular displacement arm that can be angularly displaced, and a converting mechanism for converting the angular displacement of the angular displacement arm into linear displacement via a displacement rod, and a displacement rod type regulator for detecting changes in the traveling tension of the web and changing the fluid pressure supplied by the fluid pressure supply source in accordance with the changes in the traveling tension detected by the tension sensing mechanism.

7. A paper roll braking device as set forth in claim 6 wherein the displacement rod type regulator comprises a displacement rod type regulator part for setting a fluid pressure for controlling the traveling tension of the web during the normal operation of the rotary press, and another displacement rod type regulator part for setting a higher fluid pressure for the emergency stop of the rotary press.

8. A paper roll braking device as set forth in claim 1 wherein the outside diameter detecting section comprises a rotary speed detecting means for detecting the rotary speed of the supporting member, so that the outside diameter of a paper roll from which a web is paid off can be detected based on the rotary speed detected by the rotary speed detecting means and the operating speed of the rotary press.

9. A paper roll braking device as set forth in claim 8 wherein the rotary speed detecting means is a rotary encoder.

10. A paper roll braking device as set forth in claim 1 wherein the outside diameter detecting section uses a transmission type or reflection type phototube to directly detect the outside diameter of the paper roll.

11. A paper roll braking device as set forth in claim 3 wherein the operation control section generates a first correction signal for correcting a signal that is currently generated so as to prevent the slack of the web.

12. A paper roll braking device as set forth in claim 3, wherein the contact pressure adjusting section comprises a tension sensing mechanism that is a tension sensor for detecting changes in the traveling tension of the web, and an electric-pneumatic converter in fluid connection with the engage disengage changeover section for changing a fluid pressure supplied by a fluid pressure supply source in accordance with the changes in the traveling tension detected by the tension sensing mechanism.

13. A paper roll braking device as set forth in claim 3, wherein the contact pressure adjusting section has a tension sensing mechanism comprising an angular displacement arm having a rotatable guide roller for guiding the web, a fluid pressure cylinder for imparting a force resisting the traveling tension of the traveling web to the angular displacement arm that can be angularly displaced, and a converting mechanism for converting the angular displacement of the angular displacement arm into linear displacement via a displacement rod, and a displacement rod type regulator for detecting changes in the traveling tension of the web and changing the fluid pressure supplied by the fluid pressure supply source in accordance with the changes in the traveling tension detected by the tension sensing mechanism.

14. A paper roll braking device as set forth in claim 3, wherein the operation control section generates a second correction signal for correcting a signal for corrected a signal that is currently generated when the outside diameter detecting section detects that the outside diameter of the paper roll reaches a splicing-ready diameter, and generates a splicing signal for splicing the traveling web to a paper roll from which the web is not being paid off when the rotary peripheral speed of the paper roll from which the web is not being paid off agrees with the traveling speed of the currently traveling web.

15. A paper roll braking device as set forth in claim 1, wherein the operation control section generates a second correction signal for correcting a signal that is currently generated when the outside diameter detecting section detects that the outside diameter of the paper roll reaches a splicing-ready diameter, and generates a splicing signal for splicing the traveling web to a paper roll from which the web is not being paid off when the rotary peripheral speed of the paper roll from which the web is not being paid off agrees with the traveling speed of the currently traveling web.

* * * * *